US006889651B2

(12) United States Patent
Tanaka et al.

(10) Patent No.: US 6,889,651 B2
(45) Date of Patent: May 10, 2005

(54) ENGINE AND PERSONAL WATERCRAFT EQUIPPED WITH ENGINE

(75) Inventors: Yoshinobu Tanaka, Hyogo (JP); Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/352,290

(22) Filed: Jan. 27, 2003

(65) Prior Publication Data

US 2003/0140888 A1 Jul. 31, 2003

(30) Foreign Application Priority Data

Jan. 29, 2002 (JP) ..... 2002-019362

(51) Int. Cl.[7] ..... B63H 21/10
(52) U.S. Cl. ..... 123/196 R
(58) Field of Search ..... 123/196 R, 196 M, 123/196 S, 195 R, 195 C

(56) References Cited

U.S. PATENT DOCUMENTS 4,519,348 A * 5/1985 Hamilton ..... 123/195 C
5,887,564 A * 3/1999 Kawamoto ..... 123/196 R
5,951,342 A * 9/1999 Ozawa et al. ..... 440/88 R
5,951,343 A * 9/1999 Nanami et al. ..... 440/88 L
6,170,456 B1 * 1/2001 Gu et al. ..... 123/196 S
6,497,596 B1 * 12/2002 Nanami ..... 440/88 R
6,539,912 B1 * 4/2003 Beer ..... 123/196 R
6,626,140 B2 * 9/2003 Aichinger et al. ..... 123/195 A
6,644,262 B2 * 11/2003 Matsuda et al. ..... 123/196 R
6,655,341 B2 * 12/2003 Westerbeke, Jr. ..... 123/196 R
6,688,928 B2 * 2/2004 Gokan et al. ..... 440/88 L
6,705,906 B2 * 3/2004 Matsuda et al. ..... 440/38
6,719,598 B2 * 4/2004 Gokan et al. ..... 440/88 L

FOREIGN PATENT DOCUMENTS

DE 03731597 A1 * 4/1988 ..... F01M/11/06
JP 01110820 A * 4/1989

* cited by examiner

*Primary Examiner*—Noah P. Kamen
*Assistant Examiner*—Jason Benton
(74) *Attorney, Agent, or Firm*—Alleman Hall McCoy Russell & Tuttle LLP

(57) ABSTRACT

Disclosed is a personal watercraft capable of efficiently placing a dry-sump engine room and of efficiently using a dead space in the engine room. The small dry-sump engine comprises: a plurality of cylinders; at least one cylinder head provided as corresponding to the cylinders; a crankcase chamber; an oil tank chamber independent of the crankcase chamber, the oil tank chamber being located lower than the cylinder head; and an oil return passage configured such that its upper end communicates with the cylinder heads and its lower end communicate with the oil tank chamber.

25 Claims, 14 Drawing Sheets

ENGINE AND PERSONAL WATERCRAFT EQUIPPED WITH ENGINE

BACKGROUND OF THE INVENTION

1. Field of the Invention

The present invention relates to an engine and a personal watercraft equipped with the engine. More particularly, the present invention relates to a dry-sump engine having a compact structure and a personal watercraft equipped with the dry-sump engine.

2. Description of the Related Art

In recent years, so-called jet-propulsion personal watercraft have been widely used in leisure, sport, rescue activities, and the like. In the personal watercraft, the engine is contained in a body constituted by a deck and a bull. Most of the personal watercraft are straddle-type or stand-up type personal watercraft. In either type of watercraft, the body is small and a space inside the body (hereinafter also referred to as an engine room) that contains the engine is correspondingly small.

Commonly, riders enjoy active steering on the water surface, such as rolling, yawing, pitching, or jumping over the water surface. Therefore, for oil lubrication of the engine in the personal watercraft, a dry-sump system in which an oil tank chamber is typically independent of a crankcase chamber is preferably employed. As defined herein, the dry-sump engine refers to an engine in which the oil tank chamber that reserves oil for lubricating an inside of the engine is independent of the crankcase chamber.

However, the small engine room of the personal watercraft limits design freedom in arrangement of the oil tank chamber, the crankcase chamber, and pipes for lubricating oil, when the oil tank chamber is independent of the crankcase chamber or the like and the pipes are provided between the oil tank chamber and the engine side. On the other hand, within the engine room, there exists an unused space (dead space) which is too small for the oil tank chamber independent of the crankcase chamber to be arranged therein.

In the dry-sump engine in which the oil for lubrication is fed to a cam of the cylinder head and its vicinity, it is necessary to return the oil fed to the cylinder head into the oil tank chamber. In general, the oil is dropped from the cylinder head into the crankcase chamber and then is returned into the oil tank chamber therefrom through a scavenging pump. In another method, the oil from the cylinder head is returned into an oil tank chamber independent of a crankcase chamber and then is returned into an oil tank chamber through a pump. This results in a complex structure and requires a large space. Japanese Patent No. 3004917 (corresponding to U.S. Pat. No. 5,887,564) discloses such prior art.

SUMMARY OF THE INVENTION

The present invention addresses the above-described condition, and an object of the present invention is to provide an engine suitable for a personal watercraft capable of efficiently arranging the engine in a space-limited engine room inside a body, and of efficiently using a dead space inside the engine room, and a personal watercraft equipped with the engine.

According to the present invention, there is provided a dry-sump small engine comprising: a plurality of cylinders; at least one cylinder head provided as corresponding to the cylinders; a crankcase chamber; an oil tank chamber independent of the crankcase chamber, the oil tank chamber being located lower than the cylinder head; and an oil return passage configured such that its upper end communicates with the cylinder head and its lower end communicates with the oil tank chamber.

With such a structure, since the oil of the cylinder head flows through the oil return passage and is returned into the oil tank chamber because of its gravity, a high-capacity scavenging pump for returning the oil of the cylinder head into the oil tank chamber becomes unnecessary. What is needed is a small scavenging pump for returning the oil fed to the cylinder block or the crankshaft side (other than the cylinder head) into the oil tank chamber. Also, by using the oil return passage, gas pressure inside the oil tank chamber is released to the cylinder head and eventually outside the engine. For this reason, it is not necessary to provide a breather pipe on the oil tank chamber, or the breather pipe having a low breather function is satisfactory.

Preferably, the oil return passage may be formed in a wall of the engine (e.g., within a cylinder block of the engine or a wall of the crankcase chamber). With this structure, since the oil return passage is contained in the wall portion of the engine, the engine can be compactly configured. Alternatively, the oil return passage may be formed outside the wall of the engine by using a pipe.

Preferably, the engine may further comprise a cam chain tunnel communicating with the oil tank chamber at a lower end thereof, and the cam chain tunnel may be located in the engine apart from the oil return passage as seen in a plan view. In the personal watercraft equipped with such an engine, the oil fed to the cylinder head is returned into the oil tank chamber through either the oil return passage or the cam chain tunnel during acceleration, deceleration or rolling of the watercraft.

Preferably, the cam chain tunnel may be provided at an end portion of the engine in a front-and-rear direction of the engine as seen in a plan view, and the oil return passage may be provided at an end portion of the engine on an opposite side of the cam chain tunnel as seen in a plan view. With this structure, passages for returning the oil from the cylinder head into the oil tank chamber located below are provided at both end portions of the engine. In the personal watercraft in which the engine is mounted such that the longitudinal direction of the engine corresponds with the front-and-rear direction of the watercraft, the oil is smoothly returned into the oil tank chamber because of its gravity through either the cam chain tunnel or the oil return passage when the oil of the cylinder head moves forward or rearward during acceleration or deceleration of the watercraft. For example, by providing the cam chain tunnel at a front end portion of the engine and the oil return passage at a rear end portion of the engine, the oil of the cylinder head is returned into the oil tank chamber through the oil return passage even when the oil of the cylinder head moves rearward during cruising of the watercraft. During deceleration of the watercraft, the oil of the cylinder head is returned into the oil tank chamber through the cam chain tunnel. Alternatively, the cam chain tunnel may be provided at the rear end portion of the engine and the oil return passage may be provided at the front end portion of the engine. By doing so, the same functions and effects are attained.

Preferably, an oil passage with a baffle plate internally provided may be formed in the vicinity of a portion communicating with the cam chain tunnel inside the oil tank chamber or in the vicinity of a portion communicating with the oil tank chamber inside the cam chain tunnel. In the personal watercraft equipped with the engine so structured, movement of a large amount of oil from the inside of the oil tank chamber into the cam chain tunnel is suppressed when the body is abruptly inclined forwardly or is inverted.

According to the present invention, there is provided a small dry-sump engine comprising: a crankcase chamber; an oil tank chamber adjacent to and independent of the crankcase chamber; and a communicating passage for allowing an inside of the crankcase chamber to communicate with an inside of the oil tank chamber, the communicating passage having at least one expansion chamber.

In this structure, during operation of the engine, without providing the conventional gear pump-type scavenging pump, the oil in the bottom portion of the crankcase chamber is returned from the crankcase chamber into the oil tank chamber through the communicating passage, by scraping associated with rotation of the crank web, by an increase in a pressure inside the crankcase chamber (i.e., the pressure inside the crankcase chamber is higher than the pressure inside the oil tank chamber) due to blow-by gas, downward movement of the piston, or the like, and by expansion/compression of the oil containing the gas in the expansion chamber. Such an engine is compact and lightweight because of the absence of the conventional scavenging pump. In addition, a loss of an output power of the engine is reduced. Further, because of its simple structure, reliability of the engine is improved. Moreover, since the number of components is reduced, a manufacturing cost is reduced.

Preferably, the small dry-sump engine may further comprise a crankshaft attached to the crankcase chamber, the communicating passage may be provided substantially along a rotational direction of a crank web provided on the crankshaft, and an opening on the oil tank chamber side as an outlet of the communicating passage is directed substantially forward in the rotational direction of the crank web.

With such a structure, since the scraping of the oil inside the crankcase chamber, which is associated with the rotation of the crank web, is efficiently performed, the oil is returned into the oil tank chamber more efficiently.

Preferably, an inlet of the communicating passage on the crankcase chamber side may be formed by providing an opening in a wall portion of a bottom portion of the crankcase chamber so as to have end portions on a forward side and on a rearward side in the rotational direction of the crank web, the end portion on the forward side being closer to a center of the crankshaft than is the end portion on the rearward side. An opening area of the communicating passage depends on a volume of the crankcase chamber, displacement of the engine (cylinder volume), etc. As used herein, the term "forward side" refers to the direction of rotation of the crank web, shown as clockwise in the drawing and the term "rearward side" refers to the opposite direction.

With such a structure, since the scraping of the oil inside the crankcase chamber, which is associated with the rotation of the crank web, is efficiently performed, the oil is returned into the oil tank chamber more efficiently.

Preferably, the expansion chamber may be formed on the oil tank chamber side by covering the opening on the oil tank chamber side with a cover having the outlet. This makes it possible for the communicating passage having the expansion chamber to be easily provided between the crankcase chamber and the oil tank chamber adjacent to the crankcase chamber. By providing the expansion chamber, while the oil is flowing through the communicating passage and is returned into the oil tank chamber, a flow rate of the gas containing the oil decreases in the expansion chamber to cause the gas to be separated from the oil, and consequently, the oil is returned from the crankcase chamber into the oil tank chamber more efficiently. The number of expansion chambers may be two or more. With this structure, the oil is returned from the crankcase chamber into the oil tank chamber more efficiently.

Preferably, an opening dimension of an inlet of the communicating passage may be equal to approximately ⅓ to ⅕ of an inner diameter of the crankcase chamber.

Preferably, a dimension that determines a communication cross-sectional area of the expansion chamber may be equal to approximately 1.5 to 5 times the opening dimension that determines a communication cross-sectional area of the inlet.

According to the present invention, there is provided a small dry-sump engine comprising: a crankcase chamber; an oil tank chamber adjacent to and independent of the crankcase chamber; a scavenging pump provided between the crankcase chamber and the oil tank chamber for returning an oil inside the crankcase chamber into the oil tank chamber; a feed pump provided inside the oil tank chamber, for feeding the oil to a desired position of the engine; a common drive shaft for driving the scavenging pump and the feed pump; and a crankshaft for driving the drive shaft.

In the dry-sump engine so structured, the oil tank chamber is efficiently placed together with the engine in the narrow engine room of the body. The oil tank chamber is placed by efficiently using a dead space inside the engine room, i.e., a space below the engine. In addition, since the scavenging pump and the feed pump are placed between the crankcase chamber and the oil tank chamber, a space for arranging these pumps is saved and pipes connecting these pumps become unnecessary. In addition, modulus of section and geometrical moment of inertia of the bottom portion of the engine are increased, which increases rigidity of the bottom portion of the engine and reduces vibration. Since the feed pump and the scavenging pump are driven by the common drive shaft, a structure of a pump drive mechanism is simplified and the ratio of the pump drive mechanism to the oil tank chamber in volume is reduced.

Preferably, an outer peripheral wall of the oil tank chamber may be formed to cover at least a lower portion of the crankcase chamber, and part of the crankcase chamber may constitute part of a peripheral wall of the oil tank chamber. In this structure, the crankcase chamber is used as part of the oil tank chamber and a narrow space located below the engine is efficiently used. This structure increases rigidity of the bottom portion of the engine and vibration of the engine.

Preferably, the crankcase chamber may have an upper crankcase portion and a lower crankcase portion, and the engine may further comprise: an oil pan that covers a bottom portion of the lower crankcase portion; and a substantially tubular side peripheral wall portion extending downwardly from a vicinity of an upper end of the lower crankcase portion and connected at a lower end periphery thereof to an upper end periphery of the oil pan, and the oil tank chamber is defined by a bottom portion of the lower crankcase portion, the side peripheral wall portion, and the oil pan to be independent of the crankcase chamber.

Preferably, the oil tank chamber may extend to be long in a front-and-rear direction, which corresponds with the front-and-rear direction of the crankcase chamber, and a suction port of the feed pump may be located at a center in the front-and-rear direction or rearward of the center inside the oil tank chamber. As defined herein, the "front-and-rear direction" indicates an axial direction of the crankshaft. An output end of the crankshaft indicates "rear end" and the opposite end indicates "front end". In the personal watercraft equipped with such an engine, an output end of the engine corresponds to a rear end of the body in the front-and-rear direction. Therefore, the front-and-rear direction of the engine corresponds with the front-and-rear direction of the body.

By extending the oil tank chamber to be long along the front-and-rear direction of the crankcase chamber, the oil tank chamber has a shape to be adapted to an engine body such as the cylinder block and the crankcase chamber. Therefore, the entire engine is compactly configured while ensuring an adequate volume of the oil tank chamber. This structure is particularly preferable to the inline engine having multiple cylinders.

Preferably, the suction port of the feed pump may be located substantially at a center in a width direction of the crankcase chamber inside the oil tank chamber. This structure makes it possible for the oil to be fed to the respective components of the engine even when the oil inside the oil tank chamber temporarily moves in the width direction of the body by rolling or abrupt turning of the body. In addition, a space for the feed pump in the narrow engine room is saved and pipes for connecting the feed pump and the oil tank chamber becomes unnecessary. Such an engine is preferable to the personal watercraft requiring compactness.

Preferably, the oil tank chamber may extend to be long in the front-and-rear direction, which corresponds with the front-and-rear direction of the crankcase chamber, a suction port of the feed pump may be located at a center in the front-and-rear direction or rearward of the center inside the oil tank chamber, and an outlet from the scavenging pump into the oil tank chamber may be placed forward of the center in the front-and-rear direction inside the engine. For example, the outlet of the scavenging pump is preferably located in the front portion inside the oil tank chamber and the suction port of the feed pump is preferably located in the rear portion inside the oil tank chamber. In the personal watercraft equipped with the engine having such a structure, while the oil is discharged to the front portion of the oil tank chamber by the scavenging pump and moves rearward during acceleration requiring a large amount of oil, the oil is smoothly fed to proper positions of the engine by the feed pump because the suction port of the feed pump is located in the rear portion of the oil tank chamber. In this structure, bubbles being generated in the oil returned by the scavenging pump are separated into an upper space during movement of the oil from the discharge port to the suction port inside the oil tank chamber. Consequently, the feed pump is hardly affected by the bubbles. In this case, vibration of the watercraft is helpful in separating the bubbles from the oil.

Preferably, a suction pipe may be inserted from outside into the oil tank chamber to communicate with an inside of the oil tank chamber, and the oil inside the oil tank chamber may be suctioned and discharged through the suction pipe. In this structure, in an oil change, when most of the oil inside the oil tank chamber is to be discharged, taking out the engine from the engine room and discharging the oil through a drain hole in the bottom portion of the oil tank chamber, which is troublesome, becomes unnecessary.

Preferably, in the engine having the suction pipe, preferably, an oil level gauge is equipped inside the suction pipe. Thereby, a space is efficiently used and a structure is simplified.

Preferably, the oil tank chamber may be provided with a cooling chamber to allow cooling water to flow therethrough, and cooling fins may be provided on an inner wall face of the oil tank chamber, which is in contact with the cooling chamber. With this structure, the cooling of the oil is efficiently provided inside the narrow engine room.

Preferably, the engine may comprise an air-intake pipe for supplying air to a cylinder of the engine; a throttle valve provided in the air-intake pipe, and a breather pipe provided in the oil tank chamber, wherein an inside of the oil tank chamber communicates with an upstream side of the throttle valve through the breather pipe. In this structure, since a blow-by gas inside the oil tank chamber is discharged to the upstream side of the throttle valve through the breather pipe, the oil is stably discharged without being affected by variation in pressure due to an operation of the throttle valve.

According to the present invention, there is provided a personal watercraft comprising: a body constituted by a hull and a deck; and any one of the above-mentioned dry-sump small engines, the engine being mounted inside the body, wherein the oil tank chamber is provided between the crankcase chamber of the engine and the hull.

In this structure, the dry-sump engine is efficiently placed in the narrow engine room of the personal watercraft.

The above and further objects and features of the invention will be more fully be apparent from the following detailed description with accompanying drawings.

DETAILED DESCRIPTION OF THE PREFERRED EMBODIMENTS

Hereinafter, a preferred embodiment of the present invention will be described with reference to the accompanying drawings.

Figure 1:
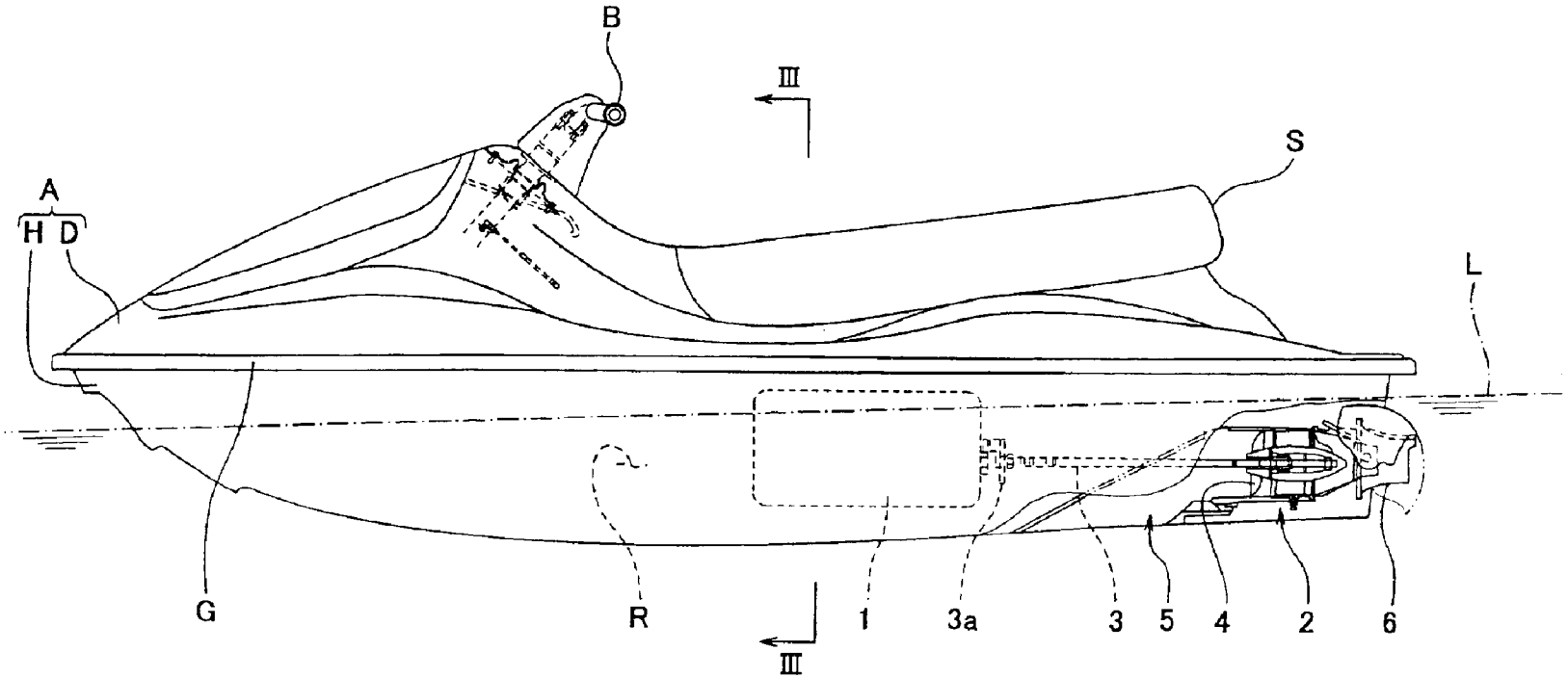
FIG. 1 is a side view schematically showing an entire personal watercraft in which an engine according to the present invention is mounted, with a rear portion of the personal watercraft being partially cutaway.
Figure 2:
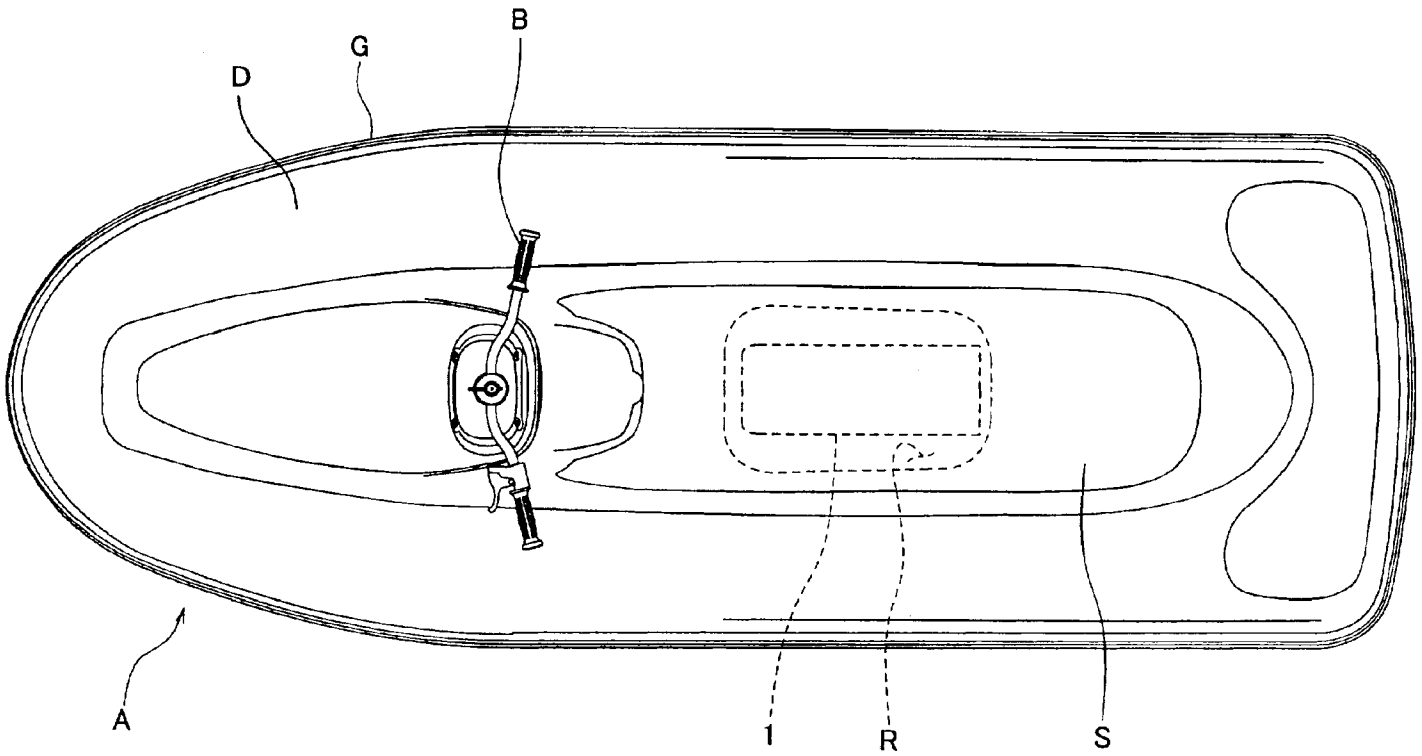
FIG. 2 is a schematic plan view of the personal watercraft in FIG. 1.
Figure 3:
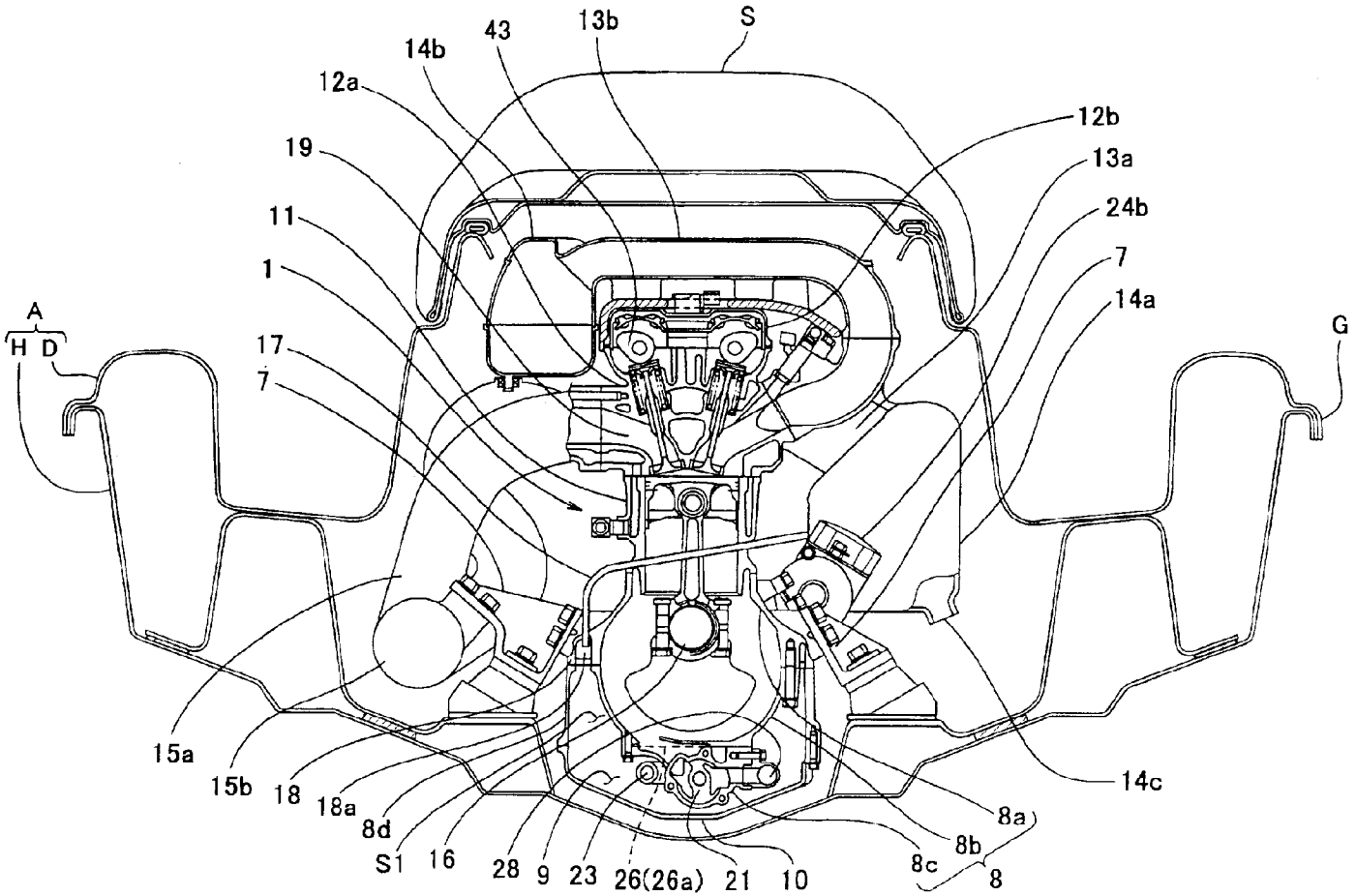
FIG. 3 is a cross-sectional view taken in the direction of arrows along line III—III in FIG. 1, showing an oil tank chamber portion transversely sectioned in the direction of arrows along line Z—Z in FIG. 5.

In FIGS. 1 to 3, reference numeral A denotes a body of the personal watercraft. The body A comprises a hull A and a deck D covering the hull H from above. A line at which the hull H and the deck D are connected over the entire perimeter thereof is called a gunnel line G. L indicates a waterline in a state of the personal watercraft.

In these Figures, a straddle-type watercraft is shown. The deck D has a raised portion extending substantially from a center portion to a rear portion of the deck D, and a straddle-type seat S is mounted over an upper surface of the raised portion to extend along front-and-rear direction (hereinafter also referred to as longitudinal direction). As used herein, a fore of the watercraft is located on the "front" side and an aft of the watercraft is located on the "rear" side. An engine 1 is disposed in a space (engine room) R surrounded by the hull H and the deck D below the seat S. A rider straddles the seat S and steers a bar-type steering handle B provided forward of the seat S and steers the watercraft.

Figure 4:
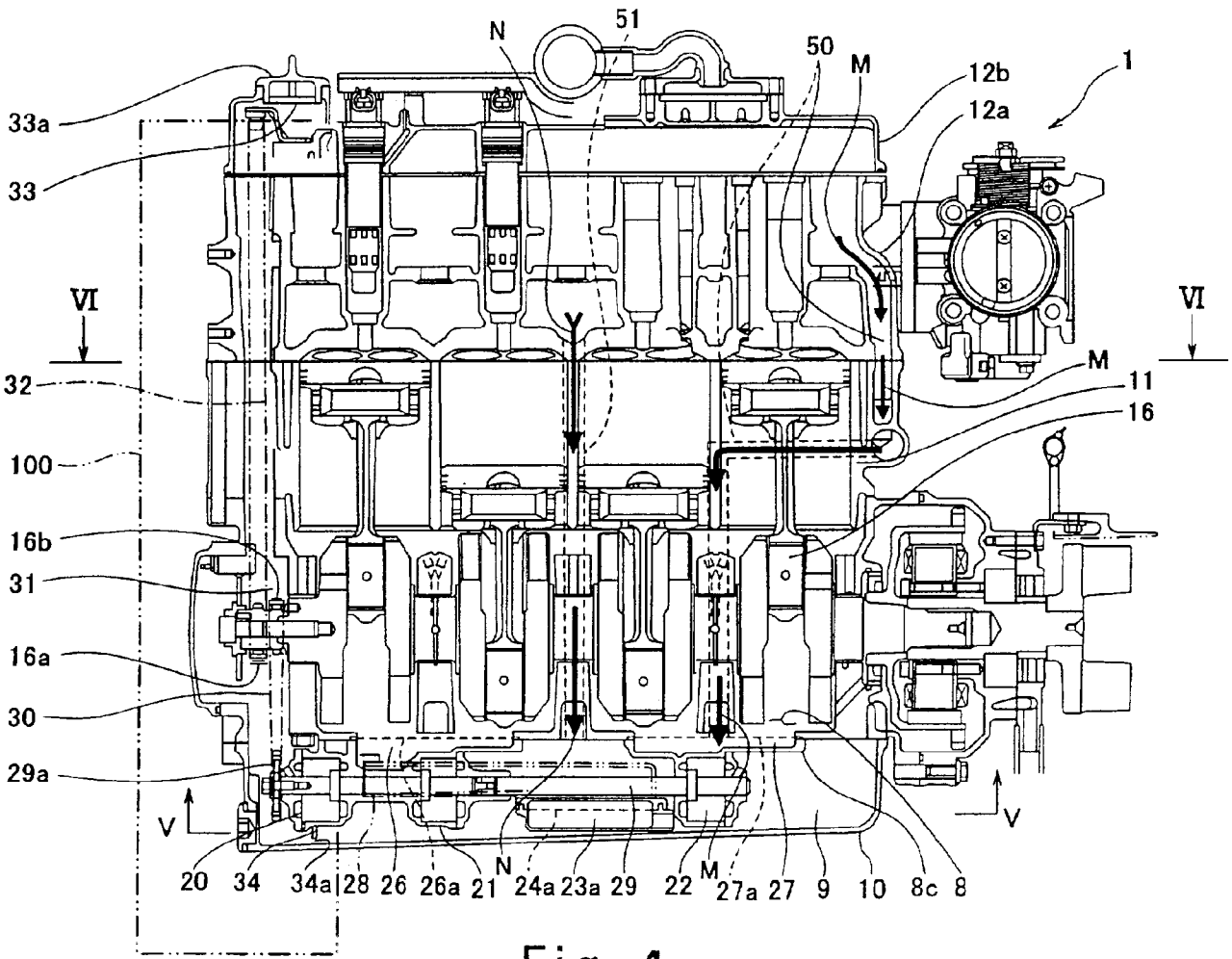
FIG. 4 is a longitudinal sectional view of an engine according to an embodiment of the present invention, which is mounted in the personal watercraft in FIGS. 1 to 3.

The engine 1 has a plurality of cylinders (e.g., four cylinders) and is mounted such that these cylinders are arranged along the longitudinal direction of the body A. Hereinafter, as shown in FIG. 4, in the front-and-rear direction of the engine 1 (front-and-rear direction of an oil tank chamber), the side where an output end of a crankshaft 16 is connected to a coupling 3*a* for connecting to a propeller shaft 3 (FIG. 1) indicates the "rear" side and the opposite side indicates the "front" side. An exhaust gas from the engine 1 is discharged from an exhaust manifold 15*a* (FIG. 3) provided in a side portion of the engine 1 into a water muffler (not shown) through an exhaust collecting pipe 15*b* (FIG. 3) and muffled therein. The resulting exhaust gas is discharged from a transom board outside the watercraft through an exhaust pipe.

The watercraft in FIG. 1 is propelled by a water jet pump 2. In this watercraft, an impeller 4 of the water jet pump 2 is rotated through the propeller shaft 3 connected to the output end of the engine 1. The water is sucked from a water intake 5 provided on a bottom surface of the hull H and pressurized and accelerated by the water jet pump 2, and the resulting water is ejected rearward from a pump nozzle 6. Thereby, the watercraft obtains a propulsion force.

As shown in FIG. 3, the engine 1 is configured such that a mounting portion of a crankcase chamber 8 is mounted on an engine mount 7 protruding from the bottom surface of the hull H. An oil tank chamber 9 of the engine 1 is provided in a space between the crankcase chamber 8 and the hull H. In this structure, the oil tank chamber 9 is formed integrally with and under the crankcase chamber 8, but the present invention is not intended to be limited to this structure. The oil tank chamber 9 may be separated from the crankcase chamber 8 so long as the oil tank chamber 9 is located between the crankcase chamber 8 and the hull H.

As shown in FIG. 3, the crankcase chamber 8 is comprised of an upper crankcase portion 8*a* removably mounted to a lower end of a cylinder block 11, a lower crankcase portion 8*b* removably mounted to a lower end of the upper crankcase portion 8*a*, and a bottom member 8*c* removably mounted to a lower end of the lower crankcase portion 8*b*. The upper crankcase portion 8*a*, the lower crankcase portion 8*b*, and the bottom member 8*c* are separable from one another. The bottom member 8*c* is provided with a feed pump 20 and two scavenging pumps 21, 22 mentioned later. To mount the feed pump 20 and the scavenging pumps 21, 22, the lower crankcase portion 8*b* and the bottom member 8*c* are independent of each other, but they may be integrally formed by casting.

As shown in FIG. 3, the lower crankcase portion 8*b* has a side peripheral wall portion 8*d* that is entirely tubular. The side peripheral wall portion 8*d* extends outwardly from an upper end of the lower crankcase portion 8*b* and then extends downwardly. A space S1 is provided between an outer portion (bottom portion) of the lower crankcase portion 8*b* and an inner face of the side peripheral wall portion 8*d* and constitutes part of the oil tank chamber 9. An oil pan 10 is removably mounted to the side peripheral wall portion 8*d* such that the periphery of an upper end of the oil pan 10 is in contact with the periphery of a lower end of the side peripheral wall portion 8*d*. The oil pan 10, the side peripheral wall portion 8*d*, and the lower crankcase portion 8*b* define the oil tank chamber 9. As should be appreciated, the oil tank chamber 9 is independent of and below the crankcase chamber 8. In this structure, the oil tank chamber 9 is separated from the crankcase chamber 8 by the lower crankcase portion 8*b* and the bottom member 8*c*. Thus, using the dead space between the crankcase chamber 8 and the hull H, the oil tank chamber 9 is efficiently provided. In this manner, the dry-sump oil tank chamber 9 is efficiently contained within the space-limited engine room R.

As shown in FIG. 3, the oil tank chamber 9 has a width slightly larger than that of the crankcase chamber 8. As shown in FIG. 4, the oil tank chamber 9 has a dimension approximately equal to the longitudinal length of the engine 1 (longitudinal length of the crankshaft 16), i.e., a length of the crankcase chamber 8. In other words, the cylinders are arranged along the front-and-rear direction of the watercraft and the oil tank chamber 9 is placed below the cylinders (crankcase chamber 8). This results in the oil tank chamber 9 that is long in the front-and-rear direction of the body A. In this structure, the oil tank chamber 9 is shaped so as not to protrude outwardly more than the crankcase chamber 8 and the cylinder block 11 do. This makes the entire engine 1 compact. The engine 1 is mounted at a center in a width direction of the body A and the oil tank chamber 9 is also located at the center in the width direction of the body A.

In FIG. 3, reference numeral 11 denotes the cylinder block, 12*a* denotes the cylinder head, 12*b* denotes a head cover, 13*a* and 13*b* denote a first air-intake pipe and a second air-intake pipe, respectively, 14*a* and 14*b* denote a first air-intake box and a second air-intake box, respectively, 15*a* denotes an exhaust manifold, and 15*b* denotes an exhaust collecting pipe. Combustion air flows from an air-intake hole 14*c* into the first air-intake box 14*a* and then into the second air-intake box 14*b* through the first air-intake pipe 13*a*. Then, the air is delivered into the cylinder through the second air-intake pipe 13*b*. The first air-intake pipe 13*a* is provided with a throttle valve which is not shown in FIG. 3, because the throttle valve is located on a far side in the direction orthogonal to a cutaway surface in FIG. 3.

As shown in FIG. 3, a breather pipe 17 is mounted to the oil tank chamber 9. One end of the breather pipe 17 opens in an upper portion of the oil tank chamber 9, for example, in a concave portion 18*a* of a flange portion 18 at the lower end of the upper crankcase portion 8*a* continuous with the upper end of the lower crankcase portion 8*b*, and the other end thereof is connected to, i.e., opens in, the first air-intake box 14*a*. A blow-by gas inside the oil tank chamber 9 is discharged into the first air-intake box 14*a*, i.e., to an upstream side of the throttle valve (not shown) in an air flow path, through the breather pipe 17. The discharged blow-by gas is delivered from the first air-intake box 14*a* to an exhaust passage 19 together with the air by a secondary air-supplying device (not shown) and then combusted. In this structure, the blow-by gas is discharged to the upstream side of the throttle valve without being affected by variation in a pressure due to operation of the throttle valve.

As described above, and as shown in FIGS. 3 to 5, the feed pump 20 and the two scavenging pumps 21, 22 are provided between the oil tank chamber 9 and the crankcase chamber 8. The pumps 20, 21, 22 are respectively mounted to the bottom member 8*c* (8*c*1, 8*c*2) (see FIGS. 3, 4, 8). Alternatively, the feed pump 20 and the scavenging pumps 21, 22 may be mounted to a member on the oil tank chamber 9 side, or another member for mounting the pumps may be provided, so long as these pumps are located between the crankcase chamber 8 and the oil tank chamber 9. In addition, the feed pump 20 and the scavenging pumps 21, 22 may be contained in either the oil tank chamber 9 or the crankcase chamber 8 so long as they are located between the oil tank chamber 9 and the crankcase chamber 8. The number of the scavenging pumps may be one, or three or more, instead of two.

Figure 5:
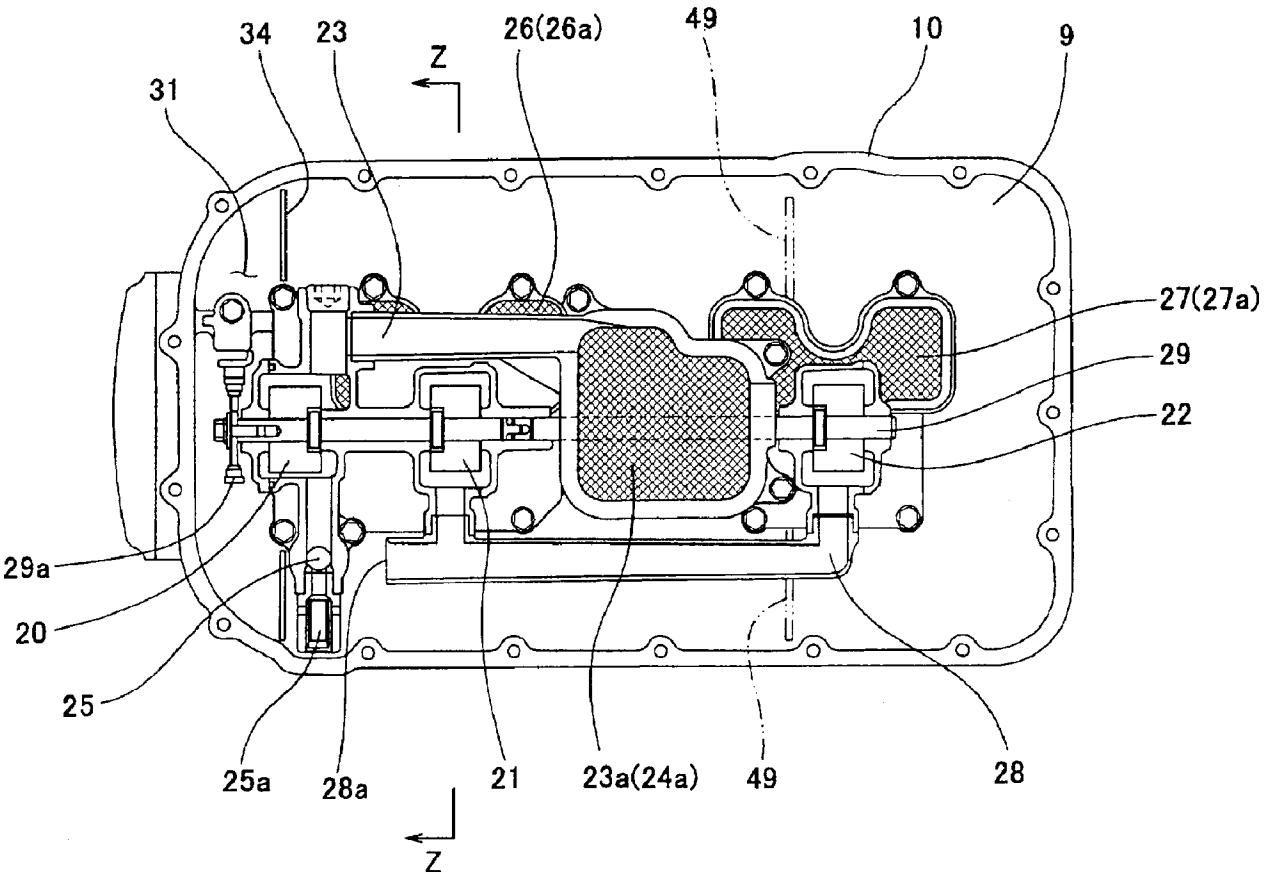
FIG. 5 is a cross-sectional view taken in the direction of arrows along line V—V in FIG. 4.

As shown in FIGS. 4 and 5, the feed pump 20 suctions and pressurizes the oil inside the oil tank chamber 9 and delivers the oil to a proper position such as a cam 43 (see FIG. 3) or the crankshaft 16 of the engine 1. Meanwhile, the scavenging pumps 21, 22 suction the oil existing in the bottom portion inside the crankcase chamber 8 because of its gravity and return the oil into the oil tank chamber 9. The cross-section of the scavenging pump 21 in FIG. 3 indicates the cross-section along line Z—Z in FIG. 5.

In FIG. 5, the oil flows through a suction passage 23 to the feed pump 20 from the oil tank chamber 9. As shown in FIGS. 4 and 5, a first filter 24*a* is provided in a suction opening 23*a* in the suction passage 23. The oil being suctioned by the feed pump 20 flows through a feed oil passage 25 (see FIG. 5) such as a main gallery and then through a second filter 24*b* (see FIG. 3) to be fed to a proper position of the engine 1, such as bearings. A relief valve 25*a* serves to relieve the oil with a higher pressure to the oil tank chamber 9.

It is desirable to locate the suction opening 23*a* at a longitudinal center of the oil tank chamber 9 or rearward of the center. In the structure in FIGS. 4 and 5, the suction opening 23*a* is located substantially at the longitudinal center. The oil inside the oil tank chamber 9 temporarily moves rearward when the watercraft starts or is abruptly accelerated during cruising, but, in such a situation, with the above structure, the oil is stably fed into respective components of the engine 1. As indicated by a two-dot chain line in FIG. 5, it is desirable to provide a baffle plate 49 immediately behind the suction opening 23*a*. The baffle plate 49 substantially defines front and rear spaces inside of the oil tank chamber 9, except for a slight oil flowing region. The baffle plate 49 serves to restrict flow of the oil inside the oil tank chamber 9. The baffle plate 49 prevents rapid movement of the oil in the front-and-rear direction. With this structure, rapid rearward movement of the oil is suppressed and the oil is smoothly fed during starting or abrupt acceleration.

As shown in FIG. 5, it is desirable to locate the suction opening 23*a* substantially at the center in the width direction of the body A. This is because the oil is fed to the respective components of the engine even when the oil inside the oil tank chamber 9 temporarily moves in the width direction of the body A by rolling or abrupt turn of the body A.

The scavenging pumps 21, 22 suction the oil from the bottom portion of the crankcase chamber 8 through return openings 26, 27 (FIG. 5), respectively. Third filters 26*a*, 27*a* are provided in the return openings 26, 27, respectively. The oil being suctioned by the scavenging pumps 21, 22 is returned into the oil tank chamber 9 through a common discharge passage 28. As shown in FIGS. 4 and 5, an exit 28*a* of the discharge passage 28 is located forward of the longitudinal center of the oil tank chamber 9. As should be appreciated from the above-mentioned structure, the oil is returned to a front portion of the oil tank chamber 9 and suctioned by the feed pump 20 from the opening 23*a* located at the center or rear portion of the oil tank chamber 9 to be delivered into the respective components of the engine. In the engine having the above structure, if the oil returned into the oil tank chamber 9 contains large bubbles, these bubbles are separated toward an upper space during movement from the front portion to the center portion (or rear portion) inside the oil tank chamber 9, and the resulting oil free from bubbles is suctioned by the feed pump P without being affected by the bubbles.

The suction passage 23, the feed oil passage 25, and the discharge passage 28 are formed in the bottom member 8*c* of the crankcase chamber 8. This eliminates a need for pipes arranged outside the engine, unlike the conventional dry-sump engine.

As should be appreciated from the foregoing, the crankcase chamber 8 is separated from the oil tank chamber 9 by the lower crankcase portion 8*b* and the bottom member 8*c* (and, further, part of the upper crankcase portion 8*a*) except portions of the crankcase chamber 8 communicating with the oil tank chamber 9 at the return openings 26, 27 through the scavenging pumps 21, 22. Such an engine is called the dry-sump engine.

The scavenging pumps 21, 22 are aligned behind and along with the feed pump 20 so as to be apart from each other in the front-and-rear direction. The pumps 20, 21, 22 are driven by a common drive shaft 20. As shown in FIG. 4, the drive shaft 29 is driven by the crankshaft 16 through a sprocket 16*b* provided at an end portion of the crankshaft 16 and a sprocket 29*a* provided at an end portion of the drive shaft 29, and a transmission chain 30 installed between the sprocket 16*b* and the sprocket 29*a*.

As shown in FIG. 4, a cam chain tunnel 31 is formed in an end portion of the engine 1, i.e., end portions (left end portions in FIG. 4) of the cylinder head 12*a*, the head cover 12*b*, the cylinder block 11, and the crankcase chamber 8. The cam chain tunnel 31 opens at its lower end in the oil tank chamber 9 and opens at its upper end in the cylinder head 12*a*. Inside the cam chain tunnel 31, a chain 30 for driving the pumps and a chain 32 for transmitting rotation of the crankshaft 16 to a camshaft (not shown) located in the upper portion of the engine 1 through the sprocket 16*a* are installed. Therefore, the oil of the cylinder head 12*a* is returned into the oil tank chamber 9 through the cam chain tunnel 31. An oil inlet 33 is formed in the head cover 12 above the cam chain tunnel 31 and a cap 33*a* is removably attached to the inlet 33 for closing the same. From the inlet 33, the oil is fed to compensate for the consumed oil.

Figure 8:
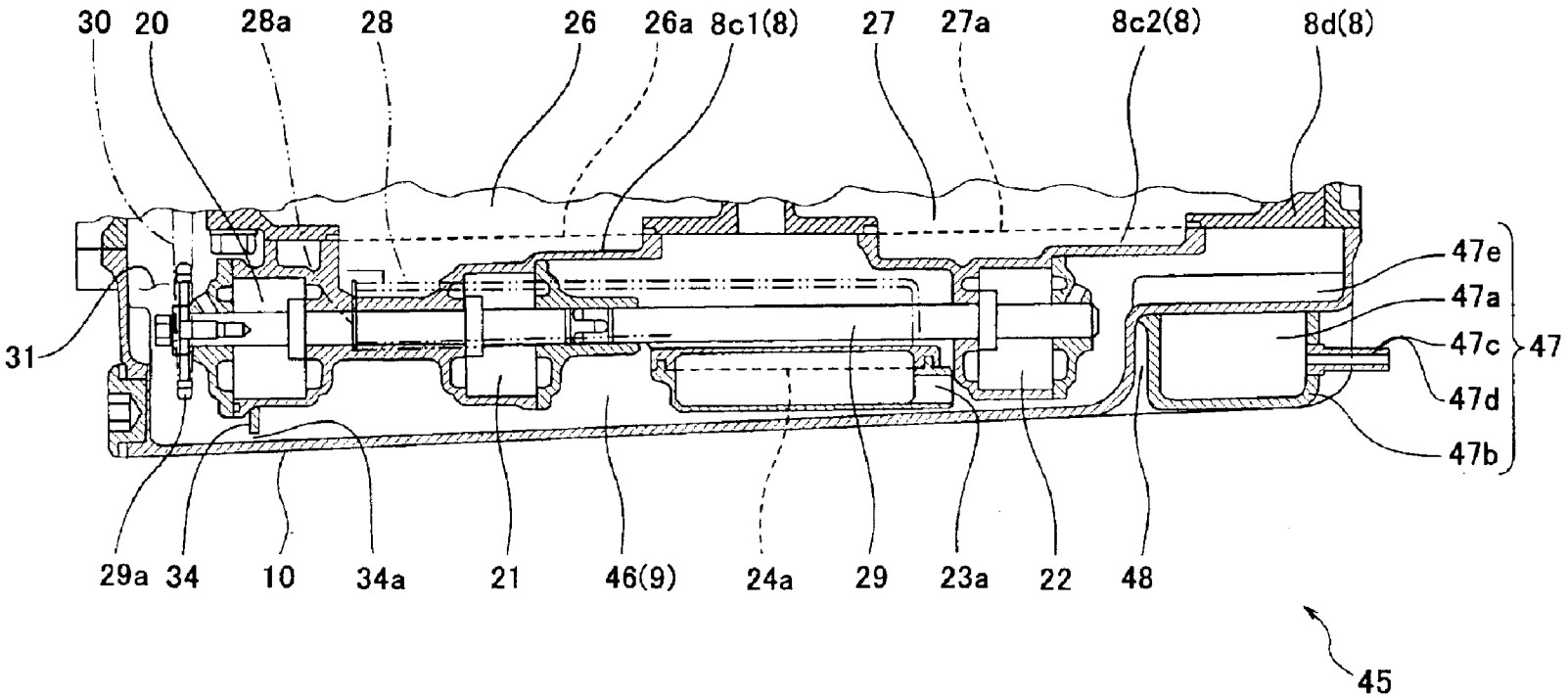
FIG. 8 is a longitudinal sectional view of an engine according to another embodiment, showing a structure of an oil tank chamber portion in the engine.

As shown in FIG. 4 or 8, a baffle plate 34 similar to the above is provided inside the oil tank chamber 9 in the vicinity of a portion communicating with the cam chain tunnel 31. A gap 34*a* is provided between a lower end of the baffle plate 34 and a bottom surface of the oil pan 10 for the oil to pass therethrough. This structure prevents a large amount of oil inside the oil tank chamber 9 from flowing into the cam chain tunnel 31 if the body A is abruptly inclined or inverted. While a slight passage of the oil is the gap 34*a* between the lower end of the baffle plate 34 and the bottom face of the oil pan 10, the present invention is not intended to be limited to the this. Alternatively, the baffle plate 34 may be provided with an oil passage hole, or otherwise, a gap may be provided between an upper end of the baffle plate 34 and the crankcase chamber 8, or between a side periphery of the baffle plate 34 and an inner side face of the oil tank chamber 9. Preferably, the oil passage is located at the lowest possible position inside the oil tank chamber 9.

The baffle plate 34 is not necessarily placed in the vicinity of the portion communicating with the cam chain tunnel 31 inside the oil tank chamber 9. For example, the baffle plate 34 may be placed in the vicinity of a portion communicating with the oil tank chamber 9 inside the cam chain tunnel 31. In an engine in which the cam chain tunnel 31 is formed in a rear end portion thereof, also, the baffle plate 34 may be placed in the vicinity of the portion communicating with the cam chain tunnel 31 inside the oil tank chamber 9 or in the vicinity of the portion communicating with the oil tank chamber 9 inside the cam chain tunnel 31. In the latter structure, the above-mentioned baffle plate 49 may be used.

Figure 6:
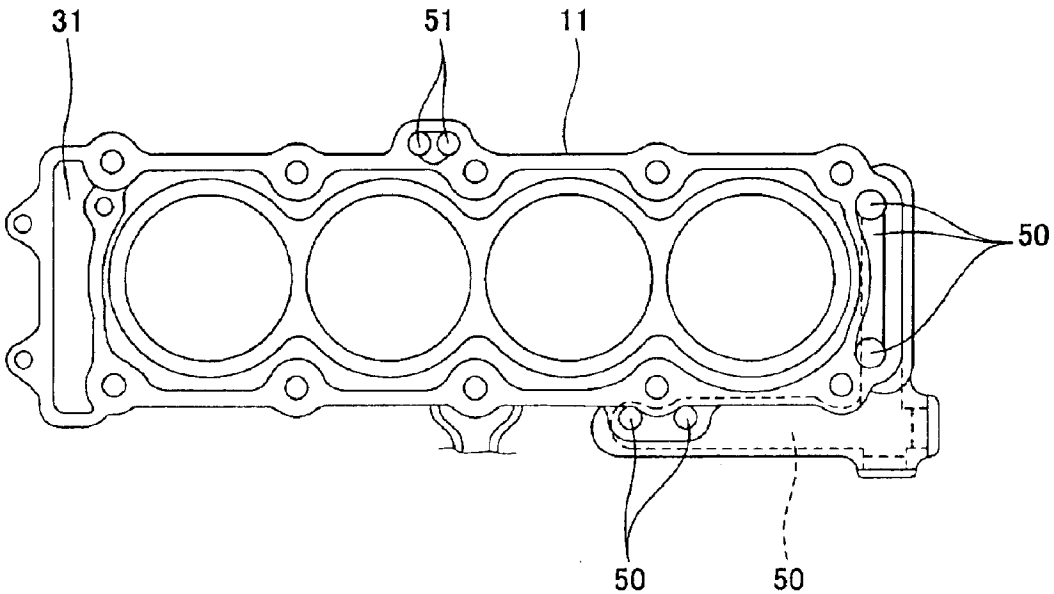
FIG. 6 is a cross-sectional view sectioned in the direction of arrows along line VI—VI in FIG. 4.

As can be seen from FIGS. 4 and 6, oil return passages 50, 51 are formed in side wall portions of the engine 1, and the oil of the cylinder head 12*a* is directly returned into the oil tank chamber 9 through the oil return passages 50, 51 without passing through the inside of the crankcase chamber 8. As shown in FIG. 4 or 6, the oil return passages 50, 51 are formed in the shape of tunnel inside side wall portions of the engine 1. The oil return passages 50, 51 are formed integrally in the side wall portion of the engine 1(the cylinder head 12*a*, the cylinder block 11, and the crankcase chamber 8).

In this structure, as shown in FIG. 6, the oil return passage 50 is located in the wall portion at an end portion of the engine 31 on the opposite side of the end portion where the cam chain tunnel 31 is formed, in the front-and-rear direction. More specifically, as indicated by an arrow M in FIG. 4, the oil return passage 50 extends from the cylinder head 12*a* to an upper end portion of the cylinder block 11, then extends through an inside of the cylinder block 11 along the front-and-rear direction, and further extends vertically downwardly through an inside of the crankcase chamber 8, to the oil tank chamber 9. As a matter of course, the oil return passage 50 may extend vertically downwardly inside the cylinder block 11 and inside the crankcase chamber 8. As shown in FIG. 4, as indicated by an arrow N, the oil return passage 51 extends vertically downwardly inside the side wall portion of the engine 1 between the cam chain tunnel 31 and the oil return passage 50 as seen in a plan view.

The number of the oil return passages is not intended to be limited to two. Nonetheless, it is preferable that at least one oil return passage is formed in the end portion of the engine 1 on the opposite side of the cam chain tunnel 31 as described above. In this structure, two passages are formed at both end portions in the front-and-rear direction of the engine 1 to allow the inside of the cylinder head 12*a* to communicate with the inside of the oil tank chamber 9. If the oil of the cylinder head 12*a* moves forwardly or rearwardly during cruising of the watercraft, the oil is returned into the oil tank chamber 9 through either the oil return passage 50 (51) or the cam chain tunnel 31.

Since the oil tank chamber 9 directly communicates with the cylinder head 12*a*, it is not necessary to provide a breather pipe in the oil tank chamber 9. That is, the blow-by gas inside the oil tank chamber 9 is discharged from the breather provided in the cylinder head through the oil return passages 50, 51 and the cam chain tunnel 31. Alternatively, as indicated by a two-dot chain line in FIG. 4, a breather pipe 100 may be provided between the oil tank chamber 9 and the cylinder head 12*a*. With this structure, a larger amount of blow-by gas or the like is released from the oil tank chamber 9 toward the cylinder head 12*a*.

Figure 7:
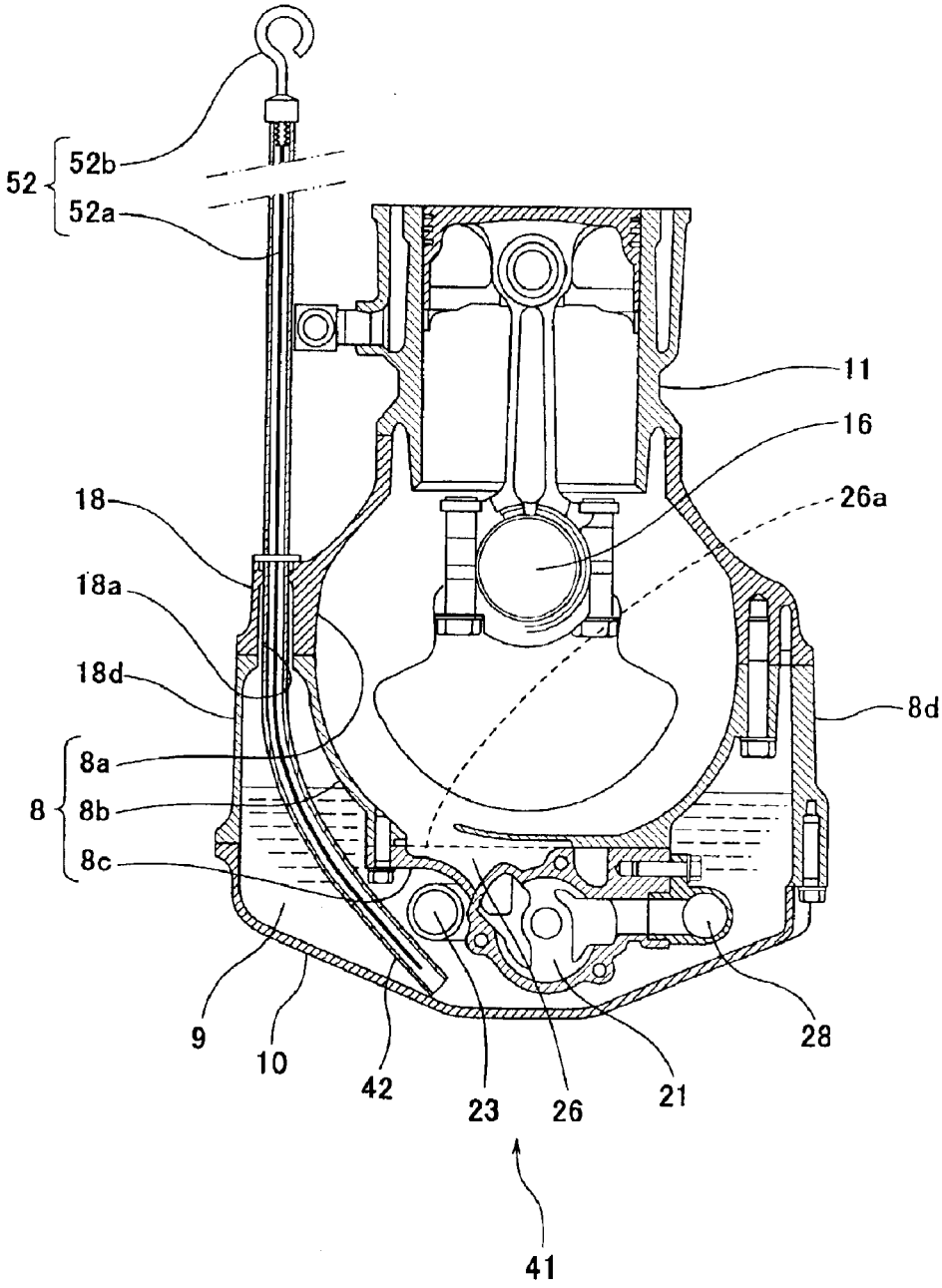
FIG. 7 is a cross-sectional view sectioned along a direction orthogonal to a longitudinal direction of an engine according to another embodiment, showing main components of the engine.

FIG. 7 shows another structure. Referring now to FIG. 7, an engine 41 is provided with a suction pipe 42 for taking out all the oil inside the oil tank chamber 9 in maintenance. The engine 41 is identical to that of the engine 1 shown in FIGS. 3 to 5 except a structure of a suction pipe 42, and the same components as those in FIGS. 3 to 5 are identified by the same reference numerals and will not be further described.

The suction pipe 42 extends from an outside of the engine 41 to the bottom portion of the oil tank chamber 9 through the upper portion of the oil tank chamber 9, i.e., the flange portion 18 of the crankcase chamber 8 and a penetrating hole formed in the concave portion 18*a* inside the oil tank chamber 9. When necessary, a suction means such as a manual pump is connected to the suction pipe 42 to allow the oil inside the oil tank chamber 9 to be discharged. Once the oil is suctioned outside the oil tank chamber 9 by operating the manual pump, most of the oil inside the oil tank chamber 9 can be taken out because of a siphon effect merely by locating an outlet of the pump lower than the oil tank chamber 9. By doing so, taking the engine out of the engine room and discharging the oil through a drain hole provided in the oil pan 10, which is troublesome, becomes unnecessary. This structure is advantageous to the personal watercraft with a small gap between the bottom portion of the body and the bottom portion of the engine.

As shown in FIG. 7, the suction pipe 42 is equipped with an oil level gauge 52. The oil level gauge 52 is comprised of a flexible long member 52*a* inserted into the suction pipe 42 and a grip portion 52*b* connected to an upper end of the long member 52*a* and fitted to the suction pipe 42. The long member 52*a* has gauges. The oil level gauge 52 is taken out of the suction pipe 42 and the oil level or the oil condition is checked when necessary.

Figure 9:
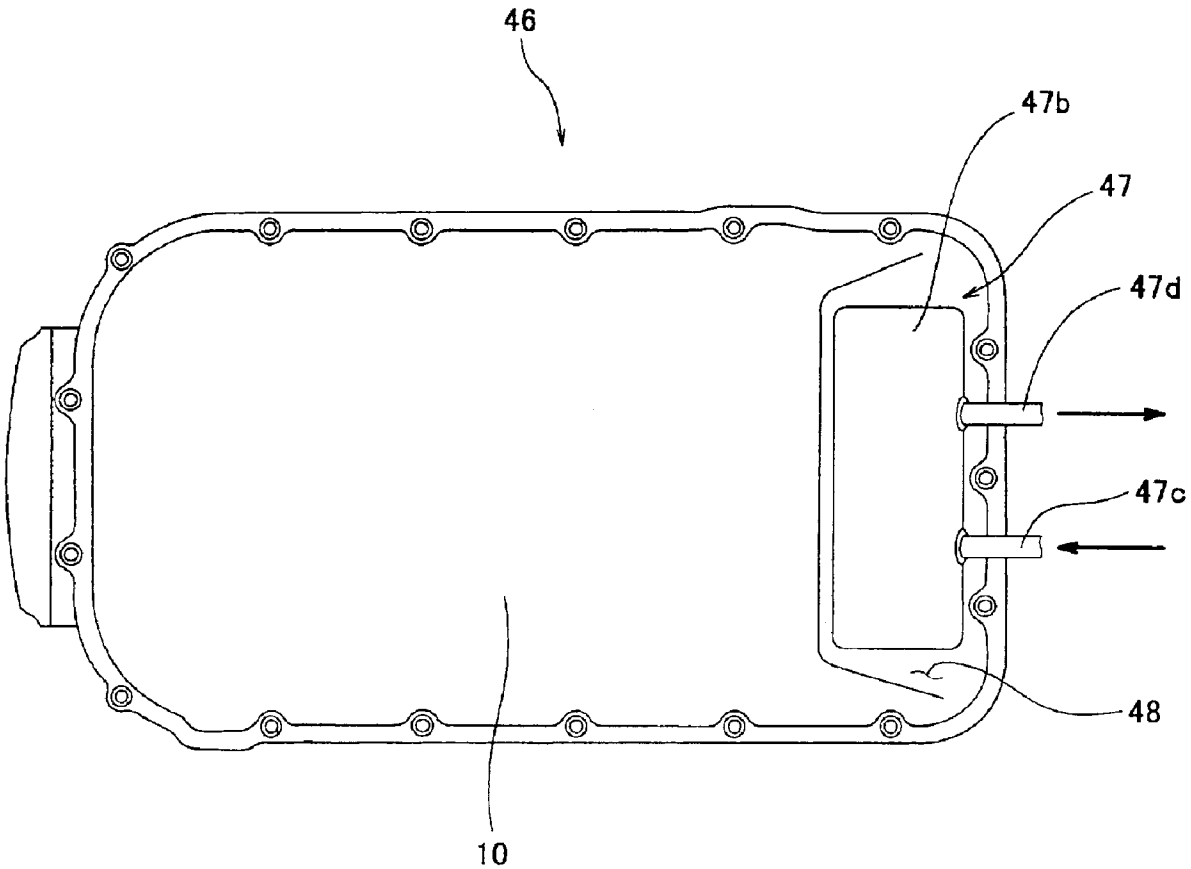
FIG. 9 is a bottom view of the oil tank chamber in FIG. 8.

FIGS. 8 and 9 show another structure. Referring to FIGS. 8 and 9, an engine 45 is configured such that an oil tank chamber 46 is provided with a cooler 47 for cooling an oil inside thereof. Since the structure of the engine 45 is identical to that of the engine 1 in FIGS. 3 to 5 except a structure of the cooler 47, the same components as those in FIGS. 3 to 5 are identified by the same reference numerals and will not be further described.

The cooler 47 has a housing 47*b* constituting a cooling water-circulating chamber 47*a* and removably attached as a water jacket to a concave portion 48 formed in a part of a bottom surface of the oil pan 10, a supply pipe 47*c*, and a discharge pipe 47*d* for circulating cooling water into the housing 47*b*, and a cooling fin 47*e* vertically provided onto an inner face of the oil pan 10, corresponding to the cooling water-circulating chamber 47*a*. By circulating the cooling water inside the cooling water-circulating chamber 47*a*, heat of the oil is absorbed through the oil pan 10 and the cooling fin 47*e*. While the cooler 47 is provided in the vicinity of a rear end of the oil pan 10 in this structure, position of the cooler 47 is not intended to be limited to this. The cooler 47 may be placed in the vicinity of a front end of the oil pan 10, at a center portion of the oil pan 10, or at other suitable position as necessary.

The cooler 47 having such a structure is placed efficiently in the space-limited engine room. The cooling water is preferably supplied from the water jet pump 2 to the cooler 47, but may be supplied by using another pump.

Figure 10:
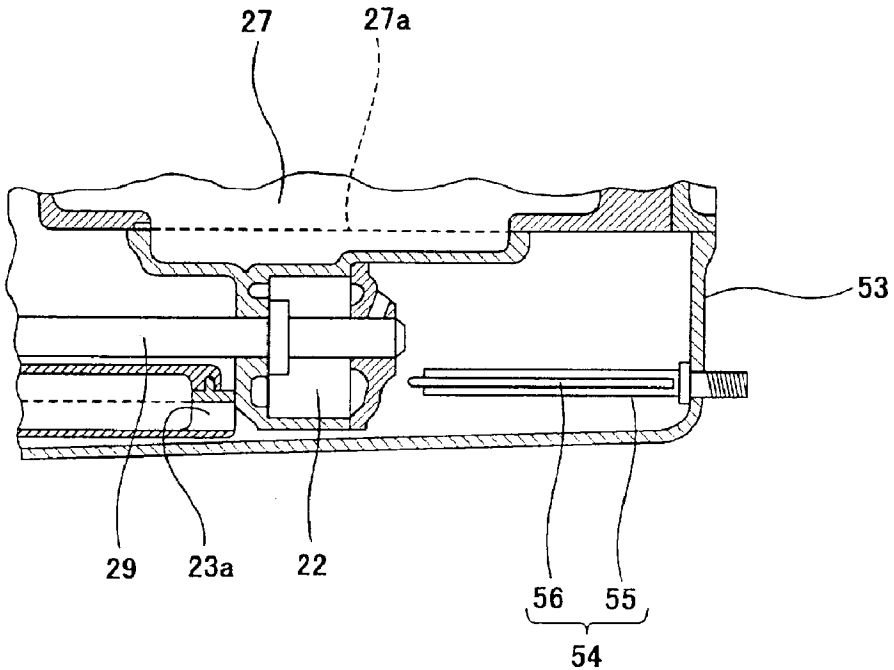
FIG. 10 is a partial longitudinal sectional view of an engine according to another embodiment, partially showing an oil tank chamber of the engine.
Figure 11B:
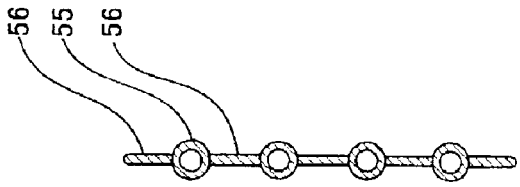
FIG. 11B is a cross-sectional view taken in the direction of arrows along line XI—XI in FIG. 11A.
Figure 11A:
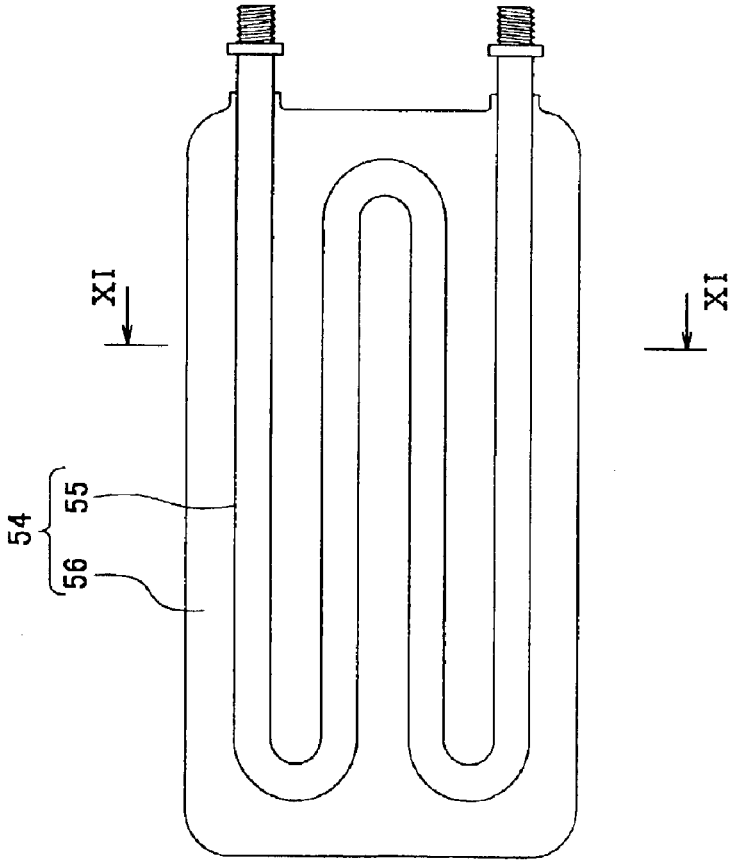
FIG. 11A is a plan view showing a cooler mounted inside the oil tank chamber in FIG. 10.

FIG. 10 shows another structure. Referring to FIG. 10, an oil tank chamber 53 is provided with a cooler 54 inserted into an inside thereof instead of the cooler formed integrally with the oil tank chamber 53. As shown in FIG. 11A or 11B, the cooler 54 is constituted by a cooling pipe 55 that snakes and cooling fins 56 fixed to the cooling pipe 55. In this cooler 54, both ends of the cooling pipe 55 protrude outwardly from the inside of the oil tank chamber 53 through two holes provided in the oil tank chamber 53, and a cooling water supply pipe and a discharge pipe are respectively connected to the protruding end portions to allow the cooling water to be supplied into the oil tank chamber 53 and the cooling water containing absorbed heat to be discharged therefrom. This is only illustrative, and by thus mounting the cooler 54 inside the oil tank chamber 53, a higher cooling effect is produced.

Figure 12:
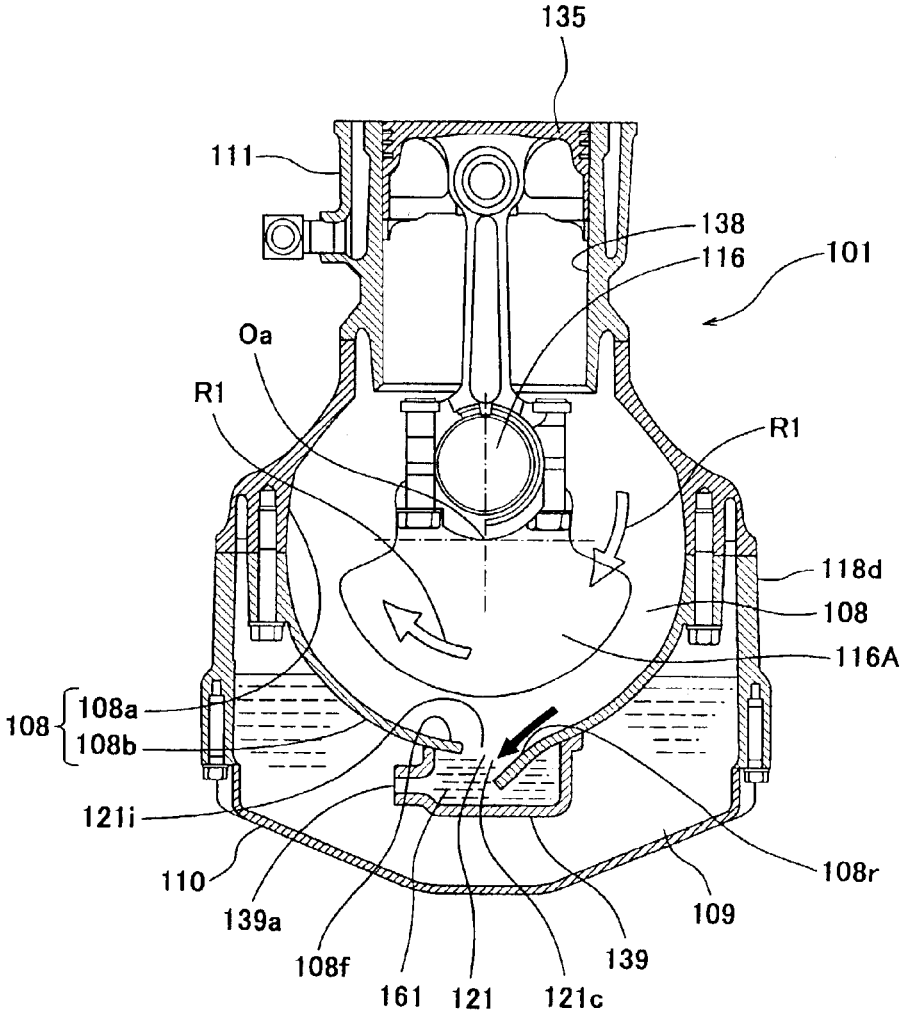
FIG. 12 is a partial cross-sectional view sectioned along a direction orthogonal to a longitudinal direction of an engine according to another embodiment, showing main components of the engine.

FIG. 12 shows another structure. An engine 101 is provided with a communicating passage 121 between a crankcase chamber 108 and an oil tank chamber 109 without the conventional gear pump-type scavenging pumps.

Specifically, as shown in FIG. 12, the communicating passage 121 is provided substantially along a rotational direction of a crank web (counter weight) 116A provided on the crankshaft 116. An opening on the oil tank chamber 109 side, i.e., an outlet 139*a* of the communicating passage 121, is directed forward (left in FIG. 12) in a rotational direction R1 of the crank web 116A of the crankshaft 116 attached to the crankcase chamber 108. An inlet 121*c* of the communicating passage 121 on the crankcase chamber 108 side is provided with an opening 121*i* having end portions 108*f*, 108*r* on forward side (left in FIG. 12) in the rotational direction R1 of the crank web 116 and on rearward side (right in FIG. 12) in the rotational direction Ri in such a manner that the end portion 108*f* on the forward side is closer to a rotational center Oa of the crankshaft 116 than the end portion 108*r* on the rearward side is, in view of delivering efficiency (pump efficiency) of the oil toward the oil tank chamber 109.

The opening 121*i* on the oil tank chamber 109 side is covered by a cover 139 having the outlet 139*a*. Specifically, as shown in FIG. 12, the cover 139 is present just below the opening 121*i*. The outlet 139*a* of the cover 139 is provided on the left side (forward in the rotational direction R1) so as to communicate with the opening 121*i* and have a small oil communication cross-sectional area. Therefore, an expansion chamber 161 is provided by a bottom portion of the crankcase chamber 108 and the cover 139 between the opening 121*i* of the communicating passage 121 and the outlet 139*a*.

In accordance with the engine 101 so structured, the oil in the bottom portion of the crankcase chamber 108 can be returned into the oil tank chamber 109 without providing the gear pump type scavenging pump shown in FIGS. 3 to 5, 7, and 8. When the engine 101 is in an operating state, the crankshaft 116 rotates clockwise in FIG. 12 and the crank web 116A mounted rotatably integrally with the crankshaft 116 correspondingly rotates clockwise. Meanwhile, the blow-by gas flows from a combustion chamber into the crankcase chamber 108 through between a piston 135 and a cylinder 138.

The oil in the crankcase chamber 108 is returned from the outlet 139*a* of the cover 139 into the oil tank chamber 109 through the communicating passage 121, by scraping action and centrifugal action due to the rotation of the crank web 116A, and due to pressure difference between a pressure inside the crankcase chamber 108 and a pressure inside the oil tank chamber 109 below the crankcase chamber 108. The pressure inside the crankcase chamber 108 is higher than the pressure inside the oil tank chamber 109 because of the blow-by gas. Since the cover 139 forms the expansion chamber 161 by covering the opening 121*i* of the communicating passage 121 from below except the outlet 139*a*, the oil is returned into the oil tank chamber 109 by expansion/compression of the gas containing the oil in the expansion chamber 161. In addition, since the oil passage is smaller at the outlet 139*a*, back flow caused by the pressure inside the oil tank chamber 109 hardly occurs. For this reason, the oil is effectively returned from the crankcase chamber 108 into the oil tank chamber 109.

While the outlet 139*a* is directed forward in the rotational direction RI of the crank web 116A for the purpose of higher efficiency, it may be directed vertically downwardly (toward the bottom of the oil tank chamber 10) in FIG. 12, or other directions. Also, the communicating passage 121 may be directed toward other directions, or may be provided at any suitable position of the crankcase chamber 108, for example, at a substantially side portion of the crankcase chamber 108.

In the engine so structured, the conventional gear pump-type scavenging pump for returning the oil from the crankcase chamber into the oil tank chamber is unnecessary regardless of the dry-sump engine. This results in a simple, compact, highly reliable, and lightweight engine. Such engine is suitable for use in the personal watercraft which requires light weight and compactness. Also, manufacturing cost is reduced because of the absence of the scavenging pump. In FIG. 12, the same components as those in FIG. 3 are identified by the same reference numerals plus 100 and will not be further described.

Figure 13:
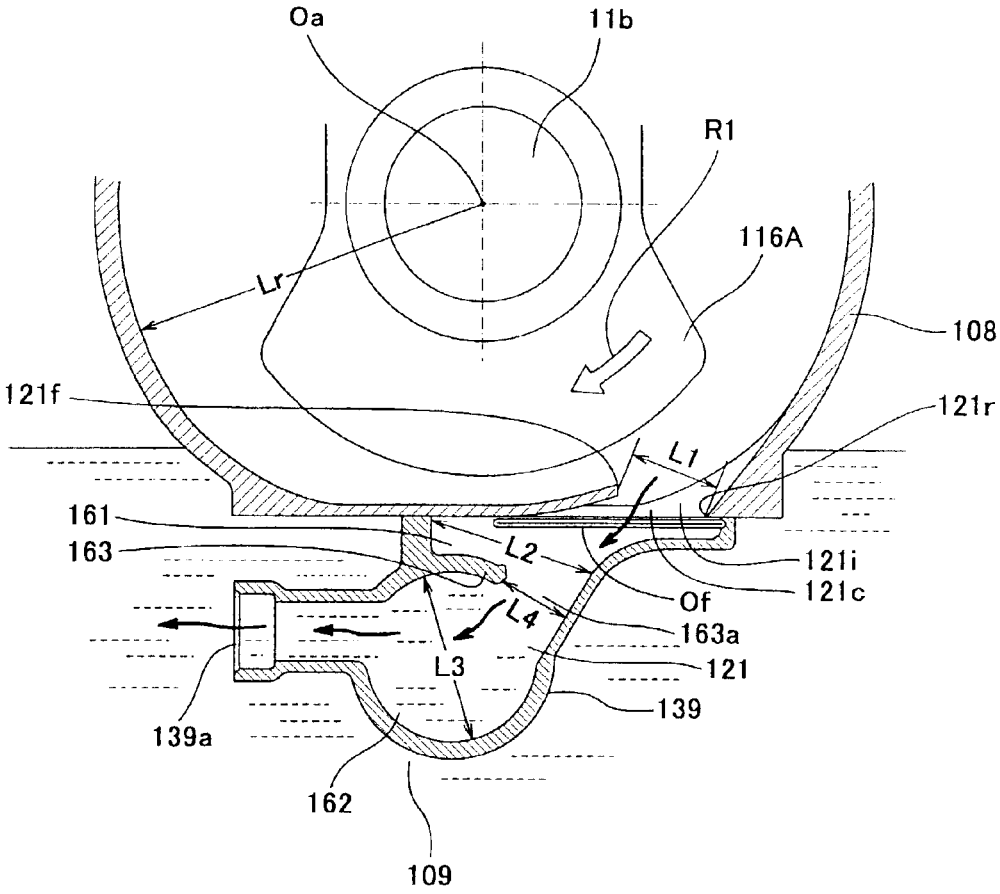
FIG. 13 is a partial cross-sectional view sectioned along a direction orthogonal to a longitudinal direction of an engine according to another embodiment, showing main components of the engine.

FIG. 13 shows another structure. While the inlet 121*c* is located right below the crankshaft 116 in FIG. 12, an inlet 121*c* of the communicating passage 121 in FIG. 13 is provided in the crankcase chamber 108 to be located rearward of the inlet 121*c* in FIG. 12 in the rotational direction (see a direction indicated by R1 in FIG. 13). In the structure in FIG. 13, the inlet 121*c* of the communicating passage 121 is provided with an opening 121*i* formed in a lower end of a side wall portion of the crankcase chamber 108 to have end portions on forward side and rearward side in the rotational direction in FIG. 13 such that the end portion 121*f* on the forward side is closer to a center of the crankshaft 116 than the end portion 121*r* on the rearward side is. The end portion 121*e* on the forward side is bent upwardly to be substantially along a rotational trace of the crank web 116A. It is desirable to set an opening dimension L1 that determines a communication cross-sectional area of the inlet 121*c* to a dimension equal to or less than substantially ¼ of an inner diameter Lr of the crankcase chamber 108. The dimensional range is not intended to be limited to ¼, but the same function is provided by setting the range to approximately ⅓ to ⅕.

Figure 14:
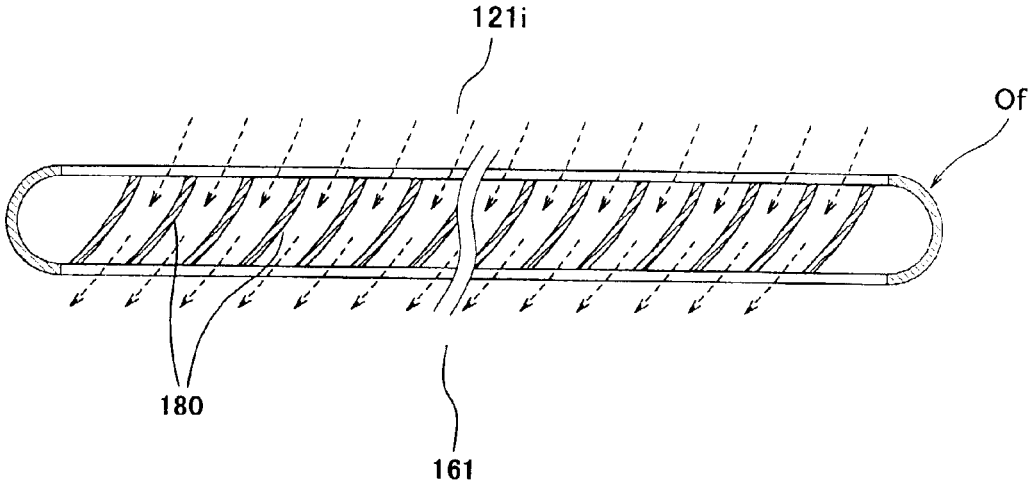
FIG. 14 is a partially enlarged cross-sectional view showing a structure of an oil filter according to another embodiment.

A mesh-type oil filter Of is provided in the inlet 121*c* of the communicating passage 121. The oil inside the crankcase chamber 108 flows into the communicating passage 121 through the oil filter Of. Alternatively, as shown in FIG. 14, the oil filter Of is preferably configured such that a number of fins 180 are arranged for the purpose of facilitating fairing the oil from the inlet 121C into the expansion chamber 161.

A first expansion chamber 161 is provided under the oil filter Of in the communicating passage 121 to have a communication cross-sectional dimension L2 larger than that of the inlet 121*c*. The communication cross-sectional dimension L2 of the first expansion chamber 161 is approximately twice as large as the dimension L1 of the inlet 121*c*. The communication cross-sectional dimension L2 of the first expansion chamber 161 is not intended to be limited to twice and may be approximately 1.5 to 5 times so long as the dimension L2 is larger than the dimension L1 of the inlet 121*c*. Nonetheless, 1.8 to 2.5 times is most preferable.

Further, a second expansion chamber 162 is formed under the first expansion chamber 161 to have a communicating portion 163*a* with a separating wall 163 provided between the first expansion chamber 161 and the second expansion chamber 162. The second expansion chamber 162 is located obliquely downwardly (e.g., obliquely leftwardly in FIG. 13 similarly to the rotational direction of the crank web 116A). A communication cross-sectional dimension L3 of the second expansion chamber 162 is approximately equal to the communication cross-sectional dimension L2 of the first expansion chamber 162. A communication cross-sectional dimension L4 of the oil communicating portion 163*a* is approximately equal to ½ of the communication cross-sectional dimensions L2, L3 of the first expansion chamber 162 and the second expansion chamber 162. As shown in FIG. 13, the second expansion chamber 162 is circular in cross-section and cylindrical in three dimensions. The second expansion chamber 162 is slightly larger in volume than the first expansion chamber 161. For example, the volume of the second expansion chamber 162 is approximately equal to 1.1 to 1.2 times of the volume of the first expansion chamber 161. Nonetheless, these volumes may be approximately equal.

An outlet 139*a* of the communicating passage 121 is provided at a front end extending laterally from the second expansion chamber 162 substantially toward the forward side in the rotational direction of the crank web 116A. The outlet 139*a* opens in the oil inside the oil tank chamber 109. In the structure in FIG. 13, the communicating passage 121 has a constant width from the inlet 121*c* to a vicinity of the outlet 139*a*. Therefore, the communication cross-sectional area of the communicating passage 121 is proportional to the ratio of the dimensions L1. L2, L3, and L4 in FIG. 13.

The engine 101 in FIG. 13 is capable of returning the oil from the crankcase chamber 108 into the oil tank chamber 109 more efficiently than the engine 101 in FIG. 12. Also, backflow of the oil from the oil tank chamber 109 toward the crankcase chamber 108 does not occur. By providing the communicating passage 121 as described above, the engine is capable of efficiently returning the oil from the crankcase chamber 108 into the oil tank chamber 109 without the necessity of providing the conventional gear pump-type scavenging pump.

The first expansion chamber 161 and the second expansion chamber 162 are not intended to be limited to the structures in FIG. 13 so long as they are adapted to expand/compress the gas containing the oil (oil mist) flowing from the crankcase chamber 108 into the oil tank chamber 109. The expansion chamber 161 in FIG. 13 may be formed by the cover 139 and an outer wall face of the bottom portion of the crankcase chamber 108 like the expansion chamber 101 in FIG. 12. At least one expansion chamber is needed, but two, three, or more chambers may be provided.

In the case of the engine 103 in FIG. 13, a portion 139 forming the first expansion chamber 161, the second expansion chamber 162, and the outlet 139*a* correspond to the cover 139 of the engine in FIG. 12. In FIG. 13, the same reference numerals as those in FIG. 12 are used to identify the same or corresponding parts. The portion below and laterally of the communicating passage 121 is surrounded by an outer wall of the oil tank chamber 109, although this is not shown in FIG. 13.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A small dry-sump engine comprising:

a plurality of cylinders;

at least one cylinder head provided as corresponding to the cylinders;

a crankcase chamber;

an oil tank chamber independent of the crankcase chamber, the oil tank chamber being located lower than the cylinder head;

an oil return passage configured such that its upper end communicates with the cylinder head and its lower end communicates with the oil tank chamber; and a cam chain tunnel communicating with the oil tank chamber at a lower end thereof;

wherein the oil return passage is formed in a wall of the engine; and wherein the cam chain tunnel is located in the engine apart from the oil return passage as seen in a plan view.

2. The small dry-sump engine according to claim 1, wherein the cam chain tunnel is provided at an end portion of the engine in front-and-rear direction of the engine as seen in a plan view, and the oil return passage is provided at an end portion of the engine on an opposite side of the cam chain tunnel as seen in a plan view.

3. The small dry-sump engine according to claim 1, wherein an outer peripheral wall of the oil tank chamber is formed to cover at least a lower portion of the crankcase chamber, and part of the crankcase chamber constitutes part of a peripheral wall of the oil tank chamber.

4. The small dry-sump engine according to claim 1, wherein a suction pipe is inserted from an outside into the oil tank chamber to communicate with an inside of the oil tank chamber, and the oil inside the oil tank chamber is suctioned and discharged through the suction pipe.

5. A small dry-sump engine comprising:

a plurality of cylinders;

at least one cylinder head provided as corresponding to the cylinders;

a crankcase chamber;

an oil tank chamber independent of the crankcase chamber, the oil tank chamber being located lower than the cylinder head; and an oil return passage configured such that its upper end communicates with the cylinder head and its lower end communicates with the oil tank chamber;

wherein the oil tank chamber is provided with a cooling chamber to allow cooling water to flow therethrough, and cooling fins are provided on an inner wall face of the oil tank chamber which is in contact with the cooling chamber.

6. A small dry-sump engine comprising:

a crankcase chamber;

an oil tank chamber adjacent to and independent of the crankcase chamber; and a communicating passage located within the oil tank chamber and having an expansion chamber, the communicating passage being provided with an inlet that opens in the crankcase chamber and an outlet that opens into the oil tank chamber;

wherein an outer peripheral wall of the oil tank chamber is formed to cover at least a lower portion of the crankcase chamber, and part of the crankcase chamber constitutes part of a peripheral wall of the oil tank chamber.

7. The small dry-sump engine according to claim 6, further comprising a crankshaft attached to the crankcase chamber, wherein the communicating passage is provided substantially along a rotational direction of a crank web provided on the crankshaft, and an opening on the oil tank chamber side as an outlet of the communicating passage is directed substantially forward in the rotational direction of the crank web.

8. The small dry-sump engine according to claim 7, wherein an inlet of the communicating passage on the crankcase chamber side is formed by providing an opening in a wall portion of a bottom portion of the crankcase chamber so as to have end portions on forward side and on rearward side in the rotational direction of the crank web, the end portion on the forward side being closer to a center of the crankshaft than the end portion on the rearward side is.

9. The small dry-sump engine according to claim 8, wherein the expansion chamber is formed on the oil tank chamber side by covering the opening on the oil tank chamber side with a cover having the outlet.

10. The small dry-sump engine according to claim 6, wherein an opening dimension of an inlet of the communicating passage is equal to approximately ⅓ to ⅕ of an inner diameter of the crankcase chamber.

11. The small dry-sump engine according to claim 10, wherein a dimension that determines a communication cross-sectional area of the expansion chamber is equal to approximately 1.5 to 5 times of an opening dimension that determines a communication cross-sectional area of the inlet.

12. The small dry-sump engine according to claim 6, wherein the communicating passage further has a second expansion chamber.

13. A small dry-sump engine comprising:

a crankcase chamber;

an oil tank chamber adjacent to and independent of the crankcase chamber;

a scavenging pump provided between the crankcase chamber and the oil tank chamber for returning an oil inside the crankcase chamber into the oil tank chamber;

a feed pump provided inside the oil tank chamber, for feeding the oil to a desired position of the engine;

a common drive shaft for driving the scavenging pump and the feed pump; and a crankshaft for driving the drive shaft.

14. The small dry-sump engine according to 13, wherein an outer peripheral wall of the oil tank chamber is formed to cover at least a lower portion of the crankcase chamber, and part of the crankcase chamber constitutes part of a peripheral wall of the oil tank chamber.

15. The small dry-sump engine according to claim 14, wherein the crankcase chamber has an upper crankcase portion and a lower crankcase portion, the engine further comprising:

an oil pan that covers a bottom portion of the lower crankcase portion; and a substantially tubular side peripheral wall portion extending downwardly from a vicinity of an upper end of the lower crankcase portion and connected at a lower end periphery thereof to an upper end periphery of the oil pan, wherein the oil tank chamber is defined by a bottom portion of the lower crankcase portion, the side peripheral wall portion, and the oil pan to be independent of the crankcase chamber.

16. The small dry-sump engine according to claim 13, wherein the oil tank chamber extends to be long in a front-and-rear direction which corresponds with a front-and-rear direction of the crankcase chamber, and a suction port of the feed pump is located at a center in the front-and-rear direction or rearward of the center inside the oil tank chamber.

17. The small dry-sump engine according to claim 16, wherein the suction port of the feed pump is located substantially at a center in a width direction of the crankcase chamber inside the oil tank chamber.

18. The small dry-sump engine according to claim 13, wherein the oil tank chamber extends to be long in a front-and-rear direction, which corresponds with front-and-rear direction of the crankcase chamber, a suction port of the feed pump is located at a center in the front-and-rear direction or rearward of the center inside the oil tank chamber, and an outlet from the scavenging pump into the oil tank chamber is placed forward of the center in the front-and-rear direction inside the oil tank chamber.

19. A personal watercraft comprising:

a body constituted by a hull and a deck; and a small dry-sump engine, the small dry-sump engine including:

a plurality of cylinders;

at least one cylinder head provided as corresponding to the cylinders;

a crankcase chamber;

an oil tank chamber independent of the crankcase chamber, the oil tank chamber being located lower than the cylinder head, and being provided between the crankcase chamber of the engine and the hull; and an oil return passage configured such that its upper end communicates with the cylinder head and its lower end communicates with the oil tank chamber, the oil return passage being formed in a wall of the engine;

a cam chain tunnel communicating with the oil tank chamber at a lower end thereof, the cam chain tunnel being located in the engine apart from the oil return passage as seen in a plan view.

20. The personal watercraft of claim 19, further comprising:

a communicating passage for allowing an inside of the crankcase chamber to communicate with an inside of the oil tank chamber, the communicating passage having at least one expansion chamber.

21. A personal watercraft comprising:

a body constituted by a hull and a deck; and a small dry-sump engine including:

a crankcase chamber;

an oil tank chamber adjacent to and independent of the crankcase chamber;

a scavenging pump provided between the crankcase chamber and the oil tank chamber for returning oil inside the crankcase chamber into the oil tank chamber;

a feed pump provided inside the oil tank chamber, for feeding the oil to a desired position of the engine;

a common drive shaft for driving the scavenging pump and the feed pump; and a crankshaft for driving the drive shaft, wherein the oil tank chamber is provided between the crankcase chamber of the engine and the hull.

22. A small dry-sump engine comprising:

a crankcase chamber;

an oil tank chamber adjacent to and independent of the crankcase chamber;

a communicating passage for allowing an inside of the crankcase chamber to communicate with an inside of the oil tank chamber, the communicating passage having at least one expansion chamber; and a crankshaft attached to the crankcase chamber, wherein the communicating passage is provided substantially along a rotational direction of a crank web provided on the crankshaft, and an opening on the oil tank chamber side as an outlet of the communicating passage is directed substantially forward in the rotational direction of the crank web.

23. A small dry-sump engine comprising:

a crankcase chamber;

an oil tank chamber adjacent to and independent of the crankcase chamber; and a communicating passage for allowing an inside of the crankcase chamber to communicate with an inside of the oil tank chamber, the communicating passage having at least one expansion chamber;

wherein an opening dimension of an inlet of the communicating passage is equal to approximately ⅓ to ⅕ of an inner diameter of the crankcase chamber.

24. The small dry-sump engine according to claim 23, wherein a dimension that determines a communication cross-sectional area of the expansion chamber is equal to approximately 1.5 to 5 times of an opening dimension that determines a communication cross-sectional area of the inlet.

25. A small dry-sump engine comprising:

a crankcase chamber;

an oil tank chamber adjacent to and independent of the crankcase chamber; and a communicating passage for allowing an inside of the crankcase chamber to communicate with an inside of the oil tank chamber, the communicating passage having at least one expansion chamber;

wherein the communicating passage further has a second expansion chamber.

* * * * *